United States Patent [19]

Trent

[11] 4,245,839

[45] Jan. 20, 1981

[54] EXERCISE DEVICE FOR RUNNING IN PLACE

[76] Inventor: Stanley G. Trent, 334 E. Park Ave., Barberton, Ohio 44203

[21] Appl. No.: 930,497

[22] Filed: Aug. 3, 1978

[51] Int. Cl.[3] ..... A63B 21/00

[52] U.S. Cl. ..... 272/116; 24/122.6; 24/127; 24/128; 24/115 N; 272/900; 272/143

[58] Field of Search ..... 272/116, 125, 142, 143, 272/900, DIG. 4; 2/338; 182/5, 6; 24/115 G, 115 R

[56] References Cited

U.S. PATENT DOCUMENTS

| | | | |
|---|---|---|---|
| 1,851,080 | 3/1932 | Becker | 182/6 |
| 3,256,015 | 6/1966 | Perrin | 272/136 |
| 3,519,269 | 7/1970 | Howlett et al. | 273/55 X |
| 3,999,752 | 12/1976 | Kupperman et al. | 272/143 X |
| 4,026,548 | 5/1977 | Birdwell | 272/143 X |
| 4,073,490 | 2/1978 | Feather | 272/136 |
| 4,109,905 | 8/1978 | Meier | 272/143 X |

*Primary Examiner*—William R. Browne
*Attorney, Agent, or Firm*—Harold S. Meyer

[57] ABSTRACT

A versatile exercise device designed particularly for running in place, against the restraining force of an anchored belt, includes a single piece of rope, one end of which is arranged for anchorage to a fixed object, and the other end of which is formed into an adjustable belt by a simple and convenient loop forming device.

1 Claim, 10 Drawing Figures

EXERCISE DEVICE FOR RUNNING IN PLACE

BACKGROUND

It has been known for a great many years that effective exercises for maintenance of physical fitness can be carried out in a limited space by muscular exertion against a restraining device. In particular, exercise of the leg muscles, as well as of the heart, lungs, back, and even arm muscles is achieved by "running in place", especially if forward pressure is exerted against a restraining device.

The restraining device for running in place generally takes the form of a broad belt or band passing around the front of the waist or of the hips of the user, and is anchored to a fixed object behind the user.

SUMMARY OF THE INVENTION

In this invention a particularly simple and effective exercising device is provided for running in place.

In its preferred form, this device consists of a single piece of essentially inextensible rope, formed into a loop of a size fitting quite loosely around the body, and preferably engaging a transversely stiff but longitudinally flexible broad waist band to distribute the pressure against a considerable area of the user's torso.

The loop may be closed by a knot, but is preferably closed by a very simple frictional holder consisting simply of a small disc or block of rigid material with a hole or holes in it, through which the rope may be passed.

The standing part of the rope, opposite to the part forming the loop, is fastened to a thin but strong and flexible tape, the free end of which is folded and sewn or otherwise fastened so as to form an enlargement which can be passed through the crack of a partly opened door or window and firmly held by closing the door or window, as will be described.

In addition, if a door or window is not conveniently accessible, the rope can be passed around any convenient strong stationary object such as a banister, post or tree, and the two portions brought together around the object can be joined by a one-and-a-half coil rigid helix, which is easily applied and removed without the need of tying a knot, or even of knowing how to tie a firm knot. At the end of tape 17, loop 21 can also be adapted to receive an "S" hook or snap fastener which can then be hooked to a chain link fence.

THE DRAWINGS

In the accompanying drawings.

DETAILED DESCRIPTION

The basic element of the exercise device of this invention is a length of rope of approximately one-fourth inch (6 mm) diameter.

Figure 1:
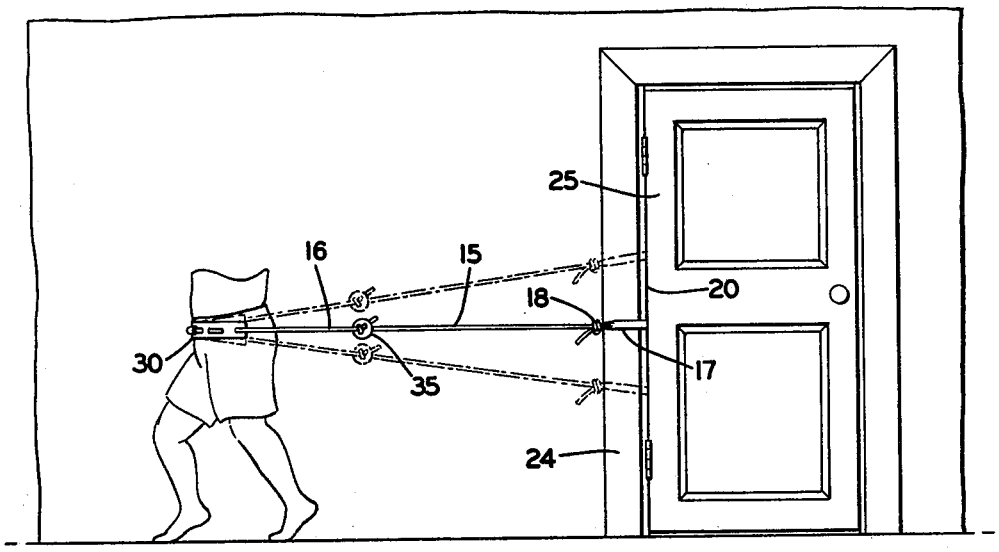
FIG. 1 shows a preferred form of the device of this invention, as it is used in exercising by running in place inside of a room.
Figure 2:
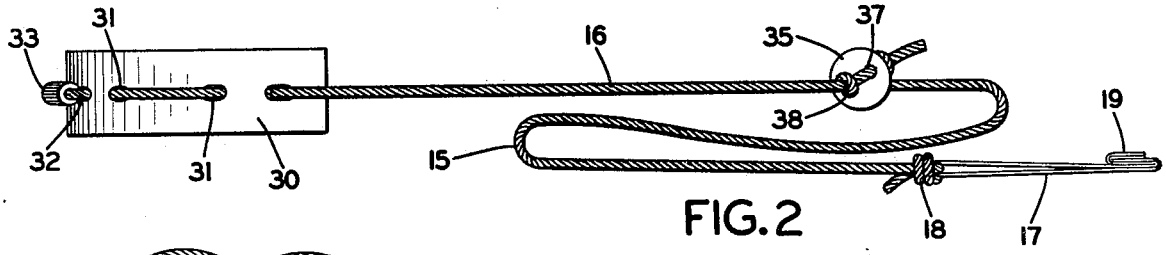
FIG. 2 shows the device alone, as seen from a side.
Figure 3:
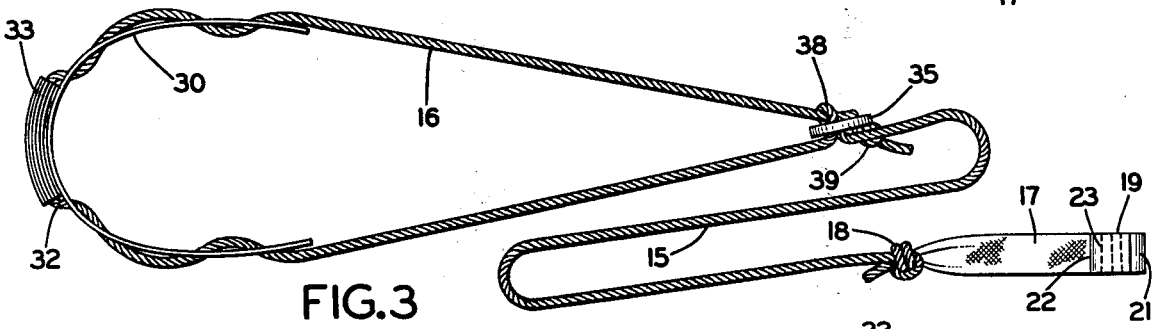
FIG. 3 shows it as seen from above.

The rope must be long enough to pass around the waist or hips of the user, with the end joined to the standing part of the rope at a distance from the user about equal to the circumference of his torso, as shown in FIG. 1 in which the rope 15 forms a loop 16 at one end, and is fastened to a tape 17 at the other end.

The rope needs to be strong enough to resist any lunge of a powerful athlete, but should also be light and flexible, and smooth to the touch. A suitable type is braided rope, preferably made of nearly inextensible continuous filaments. Such a rope has only a minor stretchability, limited largely by the tightening of the interlacing of its constituent yarns when tension is applied, and has essentially no tendency to twist under tension.

The tape 17 may be made from a similar material, braided continuous filament yarns, but in this case as a flat braid, as thin as is conveniently made in a reasonable breadth of about one-half to one inch (12 to 25 mm) and with a strength equal to that of rope 15. The tape 17 is preferably doubled to bring the ends together and form a first loop, in which the end of rope 15 is fastened, as by a firm knot 18, which can be left permanently tied.

The two ends of tape 17 may then be formed into a hold-back device by knotting or folding to produce a thickened end 19, thicker than the crack 20 of a door or window, so that the end of tape 17 can be passed through the crack 20 when the door or window is open, but not when it is closed. The end of tape 17 is passed through the crack 20 and the door or window is then closed on tape 17 while the exercise device is in use.

Figure 4:
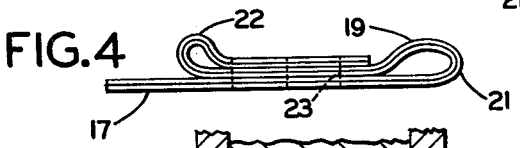
FIG. 4 shows the manner in which a two loop tape is formed for holding in the crack of a door or window.

The thickened end 19 of tape 17 may be formed by folding the parallel ends of tape 17 back against the tape and fastening the end, so folded, by stitching or riveting. Preferably, the two ends of the tape are brought together with the end faces projecting in the same direction, and the pair of tape ends is first folded back to form a small loop 21 and then folded again in the opposite direction to form another small loop or fold 22 so that the end faces are both facing in the original direction, as shown in FIG. 4. The bundle of tape thus produced is riveted or preferably firmly stitched with stout thread as shown at 23.

If desired, the tape loop 21 can be placed over a stationary hook, or can be held by an S hook to a fixed ring or a wire fence or the like.

Figure 5:
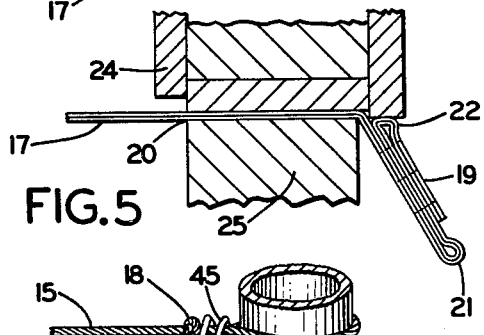
FIG. 5 shows the way it functions when gripped in the crack.

The doubled tape 17 is thin enough to lie in the crack between a door frame 24 and the door 25, but the folded and stitched end 22 when drawn against the door, as shown in FIG. 5, tends to form another double fold so that the end of the doubled and folded tape cannot be pulled through a space less than about five times the thickness of the doubled tape 17.

The free end of rope 15 is formed into a loop 16, the midpoint of the loop being intended to engage the torso of the user. For comfort, the area engaging the torso should be wider than the rope. Accordingly, a torso band 30 of stiff but flexible sheet material is provided, with several perforations 31 along its length. This band may be made of any light and strong flexible material stiff enough to distribute the pressure, such as an essentially inextensible vinyl plastic sheeting about one-sixteenth to one-thirty-second inch thick (1 mm more or less). The direction of threading should be such that the loop 16 of rope 15 will be on the outside of band 30 in locations in which pressure of the rope against ribs or hip bones might be uncomfortable.

Desirably, the part of loop 16 in the center of the length of band 30 will be passed through a short length of firm but flexible tubing 33 of a diameter such as to form a convenient hand grip.

The loop 16 is completed by fastening the free end of the loop portion of the rope to the standing part of the rope 15 so that the fastening is a suitable distance behind the user, which distance should preferably be not greatly different from the circumference of the user's torso, as already mentioned. This will assure that the tension on the rope will not exert an uncomfortable lateral pressure on the user's sides.

In addition, it is desirable that the distance of the user from the fixed support be small enough to provide a reasonable control of lateral position. As will be explained, the relative lengths of the standing part of rope 15 and of loop 16 are easily adjusted.

The fastening of the free end of loop 16 to the standing part of the rope 15 can be accomplished satisfactorily by a suitable knot such as a bowline, but in accordance with this invention it is preferably accomplished by means of a very simple fastener consisting of a perforated rigid block, which does not require the user to learn to tie a somewhat complex knot such as the bowline knot.

Figure 6:
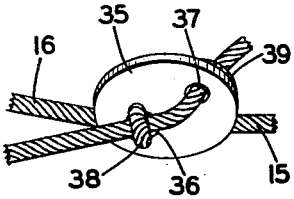
FIGS. 6 and 7 show the manner in which a rope holder with two holes forms a loop of fixed size.
Figure 7:
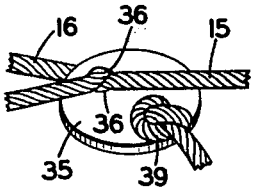

The rigid block 35, as shown in FIGS. 6 and 7, is a preferred form of fastener, providing complete security. Other forms of perforated blocks, with one, two, three, or four holes, of identical or different diameter, can also be used, but do not have all the advantages of the one shown.

The block 35 has two holes, one large hole 36 having a diameter twice that of the rope, and a small hole 37 just large enough for easy passage of a straight portion of the rope.

To form loop 16 with such a block 35 with two holes, a length of rope sufficient to form an adequate size loop 16 for the user, plus a few inches for an end knot, is measured off, and a fold 38 is formed in the rope. The fold is then pushed through the large hole 36.

The free end of loop portion 16 of rope 15, is threaded successively through perforations 31 in the torso band 30, in such a direction that the rope is on the outside of the curve of band 30 just before reaching its midpoint. The rope is threaded through hand grip 33 and then through the remaining perforations in the torso band 30.

The loop 16 which is to encircle the body of the user is then completed by pushing the fold 38 in the rope through the large hole 36 in block 35, and opening the fold to form a small loop. The free end of the rope is passed through the fold or loop 38 and then through the small hole 37 as shown in FIG. 6. A stopper knot such as overhand knot 39 is tied in the end of the rope and the knot is pulled against block 35. The large loop 16 is then pulled to draw the small loop 38 back through large hole 36 until the knotted end of the rope is tight against block 35. The result is that loop 16 is then firmly held in a fixed length against motion out of block 35 in any direction, yet is easily loosened for adjustment, by loosening the small loop 38 from the block 35, so that the rope can be pulled through in one direction or the other, to form small loop 38 in a slightly different portion of the rope.

As indicated in FIG. 1, the end of the tape 17 can be gripped by passing it through the crack 20 of a partly open door (or window) and be firmly gripped by closing the door (or window). The user will then place loop 16 around his torso in a comfortable location, lean forward against the torso band 30, and exercise by running in place. The vigorousness of the exercise will be determined not only by the pressure exerted against the torso band 30, but also by the angle of the force. Thus if the end of the rope 15 is significantly higher than the torso band 30, as shown in dashed lines in FIG. 1, a lifting component of force will be exerted on the user, and the muscular exertion will be somewhat reduced, whereas if the end of the rope is lowered, the effect will be similar to running while carrying a load, and an enhanced effect will be achieved.

The foregoing description refers to anchoring the exercise device in the crack of a door or window. Often a different form of anchorage will be preferred, in which the rope is passed entirely around a fixed object such as post 42 shown in FIG. 8. In such a situation any of several standard knots can be used to hold the rope, but in this invention an alternative holding device is provided, which is very simple, and quickly and easily manipulated without requiring any knowledge of knots, and therefore eliminating any possibility of injury because of failure of an improperly tied knot.

Figure 9:
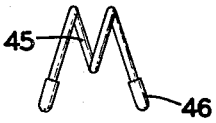
FIGS. 9 and 10 are two views of the one-and-a-half coil rigid helix shown in FIG. 8.
Figure 10:
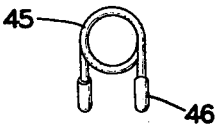
Figure 8:
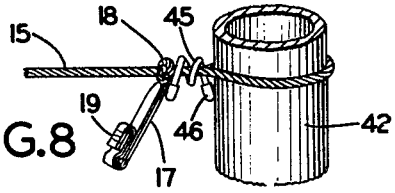
FIG. 8 shows a rigid helix holding the standing part of the rope to a post.

This fastening device, shown in FIGS. 9 and 10, consists of a rigid helix 45, made of large diameter stiff wire coiled into at least one-and-a-half full turns. This device is required to surround two parallel runs of the rope, as shown in FIG. 8, and must therefore have an internal diameter of not less than twice the diameter of the rope, and preferably slightly more than that. It is applied by threading the device over the adjacent parallel segments of the rope, which permits it to be applied in a middle location of the rope, without needing to be passed over the end. The pitch of the helix must therefore be such that the spacing between adjacent turns of the helix is slightly greater than the diameter of the rope.

When helix 45 is made, by coiling the stiff wire, the ends are preferably left straight for a short distance, for convenience in handling, and are preferably capped, as by dipping in a thick liquid plastic which solidifies to form smoothly rounded tips 46.

If it is desired to exercise the arm and shoulder muscles, that is easily accomplished with the same device, by affixation to a fixed object as described above, and grasping the hand hold 33 for exerting pulling or pushing forces. For this purpose the torso band 30 can be simply slipped toward the perforated block 35, more or less out of the way.

This exercise device is unusually simple but versatile, easily adjusted, and easily used, for effective exercise in limited spaces or fixed locations. It is lightweight, floats in water and will not rust. It can accordingly be made available at low cost to anyone interested in physical development of the upper and lower part of the body, and especially in cardiovascular improvement which can be effected by properly programmed sequences of exercise using this device.

I claim:

1. A device for running in place exercises comprising:

a flexible and essentially inextensible unitary tension rope rope of which one end is formed into a loop within which a person can exert a forward thrust on the loop, the tension rope having at its one end a holding device for removably affixing it to a fixed object for resisting tension, the free end of the loop portion of the rope being immovably but adjustably fastened to the standing part of the rope at the other end of the loop, the standing part of the rope extending beyond and away from the loop for a length sufficient to pass around a fixed object for resisting tension, the end of the rope having an enlargement, and a portion of the rope close to the enlargement lying in parallel contact with the standing portion of the rope, and a rigid helix of at least one and one half turns having a pitch resulting in a spacing between turns slightly greater than the rope diameter and an internal diameter slightly greater than twice the rope diameter, said helix surrounds the two adjacent portions of the loop portion of the rope and holds the rope against separation from a fixed object.

* * * * *